United States Patent [19]

Robinson

[11] 4,387,555

[45] Jun. 14, 1983

[54] ORNAMENTAL THREAD AND METHOD OF FORMING SAME

[75] Inventor: Stuart A. Robinson, Paxton, Mass.

[73] Assignee: Robinson Thread Company, Worcester, Mass.

[21] Appl. No.: 305,965

[22] Filed: Sep. 28, 1981

[51] Int. Cl.[3] ..... D02G 3/12; D02G 3/34

[52] U.S. Cl. ..... 57/235; 57/14; 57/31; 57/32; 57/207; 57/211; 57/236; 57/260; 57/903

[58] Field of Search ..... 57/206, 207, 210, 211, 57/232, 233, 235, 3, 13, 14, 31, 32, 903, 236, 260, 259

[56] References Cited

U.S. PATENT DOCUMENTS

| | | | |
|---|---|---|---|
| 346,577 | 8/1886 | Briggs | 57/903 X |
| 1,196,751 | 9/1916 | Akin | 57/235 |
| 1,783,315 | 12/1930 | Sexton | 57/235 |
| 2,058,783 | 10/1936 | Franke | 57/233 X |
| 2,607,185 | 8/1952 | Silverman | 57/151 |
| 2,807,132 | 9/1957 | Nadel | 57/207 |
| 2,939,271 | 6/1960 | Nadel | 57/211 |
| 2,963,850 | 12/1960 | Rosenblatt | 57/139 |
| 3,019,592 | 2/1962 | Gould et al. | 57/235 |
| 3,126,698 | 3/1964 | Scharf | 57/235 |
| 3,145,525 | 8/1964 | Laureti | 57/140 |
| 3,206,923 | 9/1965 | Price | 57/140 |

*Primary Examiner*—Donald Watkins

*Attorney, Agent, or Firm*—Blodgett & Blodgett

[57] ABSTRACT

Thread consisting of three polymer strands twisted in one direction, each strand being wrapped with a metallic strip wound in the other direction, the strands and strip being covered with an elastomer sheath.

10 Claims, 2 Drawing Figures

ORNAMENTAL THREAD AND METHOD OF FORMING SAME

BACKGROUND OF THE INVENTION

In the manufacture of clothing it is often desirable to provide an ornamentation in the form of a design stitched in a metallic thread, such as gold thread. It has been common practice to form such thread by wrapping a strip of metallic foil or the like around a strand of ordinary thread. Fairly satisfactory patterns can be produced with such thread if the stitching is performed manually and done very carefully. Such ornamentation is, however, very expensive, since a considerable amount of hand labor is involved. Attempts to use this thread on sewing machines has been very unsatisfactory, because the threads will not slide smoothly through the eye of the needle. When one attempts to use such prior art thread in the eye of a needle of sewing machines, the eye tends to tear the metallic foil, so that the free ends protrude from the pattern. Even if the foil is not torn, it may be damaged to the extent that the pattern is less than desirable in appearance. The action of the eye of the needle on the foil is accentuated by the fact that the needle reciprocates over a given part of the thread several times during the stitching operation.

One way of overcoming the deficiencies of the prior art metallic thread has been to stitch the pattern in reverse. That is to say, the operator places the garment or the shoe material in the sewing machine with the inside surface uppermost. The metallic thread is then placed on the bobbin rather than on the needle and, therefore, the metallic thread becomes the under-thread in the pattern. Since the garment has the inside surface up, the metallic thread appears on the outside surface. This method has a number of drawbacks. For one thing, it is difficult to produce an appropriate, neat pattern when the stitching is done from the wrong side of the clothing with the pattern appearing on the right side of the pattern. Secondly, it is still necessary to operate the sewing machine at slow speed, because of the fragile nature of the thread. These and other difficulties experienced with the prior art materials have been obviated by the present invention in a novel manner.

It is, therefore, an outstanding object of the invention to provide an ornamental thread having great resistance to abrasion.

Another object of this invention is the provision of an ornamental thread capable of operation through the eye of a needed of a sewing machine that is operated at high speed.

A further object of the present invention is the provision of an ornamental thread for use in making stitched patterns in clothing or the like.

It is another object of the present invention to provide a metallic thread which is simple and rugged and is capable of use where machine operation and high speed are necessary.

A still further object of the invention is the provision of a method of making a metallic thread, which is strong and rugged and is capable of being used through the eye of the needle of a sewing machine.

With these and other objects in view, as will be apparent to those skilled in the art, the invention resides in the combination of parts set forth in the specification and covered by the claims appended hereto.

SUMMMARY OF THE INVENTION

In general, the present invention consists of an ornamental thread that consists of a plurality of strands of elastomer material, which strands are twisted together in a first direction. A narrow strip of metallic film is wrapped around each strand in the opposite direction.

More specifically, the assemblage is provided with a transparent coating of polymer material. The strand is formed of nylon and the film is formed of Mylar on both sides of which has been vacuum deposited a thin layer of metal. The method of making the thread includes the step of wrapping the strip around each strand and then twisting the strands together. The assemblage is then stabilized by heating under tension with a coating of nylon applied.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
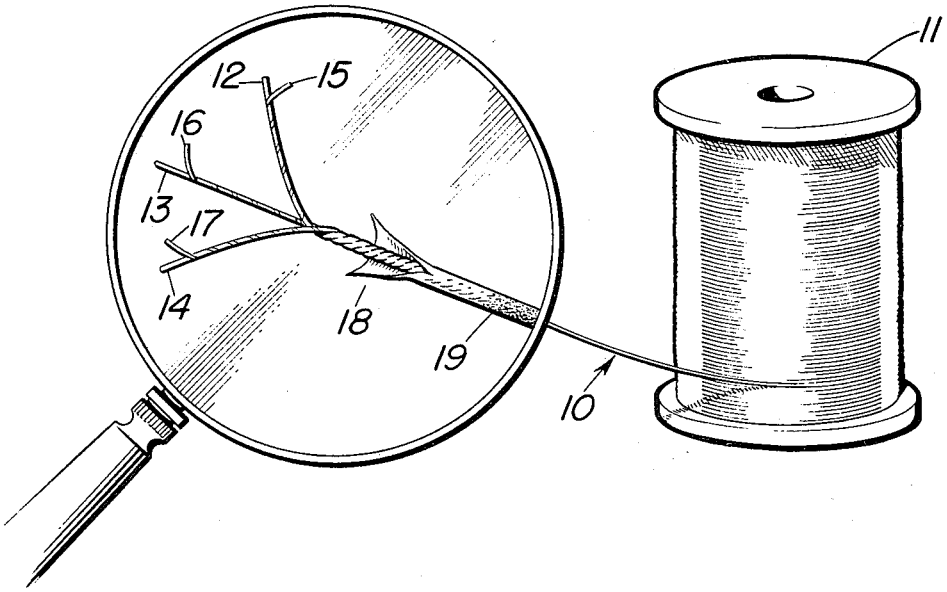
FIG. 1 is a perspective view of a supply of ornamental thread made in accordance with the principles of the present invention, a portion being enlarged for easier study.

FIG. 1 shows the ornamental thread, indicated generally by the reference numeral 10, in the form of a commercial product carried on a spool 11. The thread consists of three strands 12, 13 and 14 formed of polymer. These three strands are wound together in a first direction. A narrow strip 15 of metallic film is wrapped around the strand 12, while similar strips 16 and 17 are wrapped around the strands 13 and 14, respectively. These strips are all wrapped in the direction opposite the direction of twist of the strands. A coating 18 is applied over the entire assemblage of strands and strips, the coating consisting of a transparent polymer. Finally, a film of lubricant is applied to the outer surface of the polymer coating.

In the preferred embodiment, each of the strands 12, 13, and 14 has a circular cross-section and is formed of nylon and each of the strips 15, 16 and 17 is formed from a film of Mylar to both surfaces of which has been applied (by the vacuum deposition method) a film of aluminum which may be anodized to give a gold appearance or the like. Each of the strips 15, 16 and 17 is approximately 0.05 inches wide and the thickness of the strip is very small as compared with the diameter of the strand around which it is wrapped.

Figure 2:
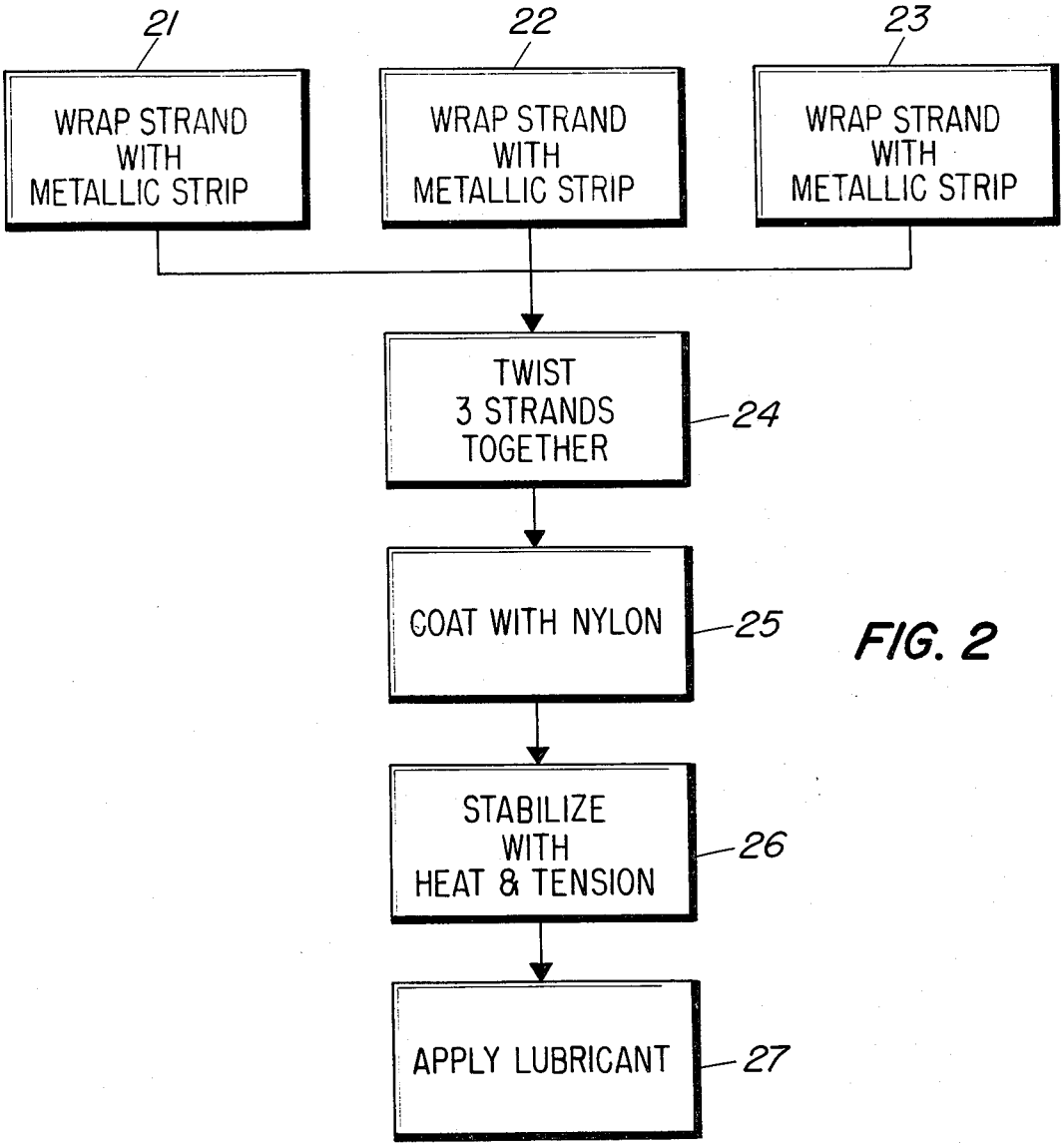
FIG. 2 is a flow diagram illustrated the method of making the ornamental thread.

FIG. 2 shows the method by which the thread 10 is made. Each of the steps 21, 22 and 23 are individual operations in which the strip of metallic film is wrapped around a strand. The wrapping or twisting of the strip around the strand takes place in such a manner that the strip lies in a helix with turns that are spaced by an amount approximately equal to the width of the strip. The next step 24 consists of twisting the three strands 12, 13 and 14 with their strips together. The direction in which the strands are twisted together is exactly opposite the direction of twist of the strips around the strands. In step 25 the assemblage of strands is then passed through a bath of liquid nylon which provides it with the transparent coat 18. Immediately, thereafter, the assemblage is subjected to step 26 in which it is subjected to heat and tension to effect the stabilizing of the entire assemblage and the polymerizing of the nylon coating 18. Finally, in step 27 the film 19 of lubricant is applied to the outer surface of the coating 18.

The manner of use and the advantages of the present invention will now be readily understood in view of the above description. The ornamental thread 10 is used in stitching patterns on clothing including, for instance, the uppers of shoes and boots. It is used as the upper thread in a sewing machine and, therefore, passes from its spool 11 to the eye of the needle. Thus, it appears on the upper or show side of the piece of clothing being provided with the ornamentation. As is well-known in machine stitching, the needle reciprocates over any given section of its thread several times before the thread is left behind in the cloth or leather. Normally, this is a cause of considerable disruption to any thread which is not absolutely stable. In the present case, the fact that the metallic strip is securely wound around its strand and wound in the opposite direction from the direction of twisting of the strands means that the metallic film is securely locked in place. As is well-known from the study of geometry, it is difficult (if not impossible) to wind a straight strip helically onto a cylindrical surface so that it lies smoothly. There will always be an edge which extends away from the strand. In the present case, the winding takes place with considerable tension and the twisting adds to this. However, in the stabilizing step, the heat and tension minimize this effect; since both the nylon and the Mylar are thermoplastics, the use of the heat and tension causes the strips to lie absolutely flat on the surface of their strands, so that they do not project outwardly. In the same way the use of the transparent nylon film 18 serves to smooth out the surface and remove any tendency for edges of the film to catch on the edges of the eye of the needle of the sewing machine. A commercial embodiment of the invention, when used with high speed sewing machine, has resulted in metallic thread ornamentation in which the metallic materials do not separate from the strand nor do they tear or fray. The pattern of ornamentation feels and appears smooth.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Ornamental thread, comprising:

(a) a plurality of strands of polymer material, the strands being twisted together in a first direction, and (b) a narrow strip of metallic film wrapped around each strand in the other direction.

2. Ornamental thread as recited in claim 1, wherein a coating of a transparent polymer is carried on the assemblage.

3. Ornamental thread as recited in claim 2, wherein a film of lubricant is carried on the outer surface of the coating.

4. Ornamental thread as recited in claim 1, wherein each strand is formed of nylon, and the metallic film is Mylar both surfaces of which is coated with metal.

5. Ornamental thread as recited in claim 4, wherein the strip is in the order of 0.05" wide, and the metal is vacuum deposited aluminum.

6. Ornamental thread as recited in claim 1, wherein the thickness of the strip is very small compared with the thickness of the strand around which it is wrapped.

7. Method of forming an ornamental thread, comprising the steps of:

(a) wrapping each one of a plurality of polymer strands with a narrow strip of metallic film in a helical path in one direction, and (b) twisting the said plurality of strands together in the opposite direction to lock the metallic strips in place.

8. Method of forming an ornamental thread as recited in claim 7, including the step of applying a coating of a transparent polymer to the exterior surfaces of the strands and strips, and stabilizing the assemblage with heat and tension.

9. Method of forming an ornamental thread as recited in claim 8, including the step of applying a lubricant to the outer surface of the coating.

10. Method of forming an ornamental thread as recited in claim 8, including the steps of applying a metallic layer of aluminum to both sides of a sheet of Mylar by the vacuum deposition process, and then cutting the sheet into the said narrow strips approximately 0.05" wide.

* * * * *